US006363695B1

(12) United States Patent
Mykkänen

(10) Patent No.: US 6,363,695 B1
(45) Date of Patent: Apr. 2, 2002

(54) METHOD FOR CLOSING A LIQUID PACKAGING CONTAINER

(75) Inventor: Ensio Mykkänen, Valkeakoski (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 09/658,656

(22) Filed: Sep. 8, 2000

Related U.S. Application Data

(63) Continuation of application No. PCT/FI99/00796, filed on Mar. 16, 1999.

(30) Foreign Application Priority Data

Jun. 29, 1998 (FI) ..... 981496

(51) Int. Cl.[7] ..... B65B 7/28
(52) U.S. Cl. ..... 53/486; 53/485
(58) Field of Search ..... 53/426, 485, 486, 53/488, 432

(56) References Cited

U.S. PATENT DOCUMENTS 4,338,765 A 7/1982 Ohmori et al.
4,771,903 A * 9/1988 Levene et al. ..... 53/485
4,967,538 A 11/1990 Leftault, Jr. et al.
5,054,265 A * 10/1991 Perigo et al. ..... 53/486

OTHER PUBLICATIONS

International Search Report, International application No. PCT/FI99/00196, Aug. 19, 1999.

* cited by examiner

*Primary Examiner*—John Sipos
(74) *Attorney, Agent, or Firm*—Fitch, Even, Tabin & Flannery

(57) ABSTRACT

The object of the invention is a method for use in connection with closing a liquid packaging container, the said container comprising a cylindrical or truncated cone-like casing part (1) and end members (2,3) connected to it, of which at least one (3) is formed of fiber-based, such as board-based material, for example, liquid packaging board, and comprises a skirt (15) folded in the direction of the casing part, by which skirt the end member is connected to the casing (1), in which method the container, which is finished at least with respect to its casing part (1) and the said one end member, is filled with a liquid (4) and the container is closed. According to the invention, the surface of one end member (3) which is on the outside of the container is moistened before the container is closed, thus reducing its rigidity to such an extent that the end member can be used in a bellows-like manner for controlling the pressure inside the container.

6 Claims, 1 Drawing Sheet

METHOD FOR CLOSING A LIQUID PACKAGING CONTAINER

Figure 1:
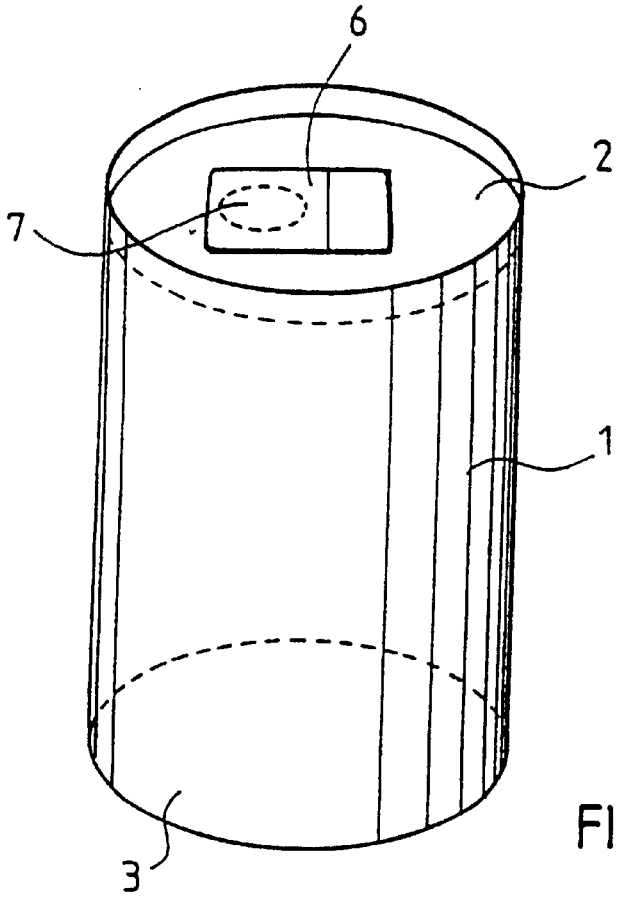

This application is a continuation of PCT/FI99/00196 filed Mar. 16, 1999.

PRIOR ART

The object of the present invention is a method for use in connection with closing a liquid packaging container, the said container comprising a cylindrical or truncated cone-like casing part and end members connected to it, of which at least one is formed of fibre-based, such as board-based material, for example, liquid packaging board, and comprises a skirt folded in the direction of the casing part, by which skirt the end member is connected to the casing, in which method the container, which is finished at least as concerns its casing part and the said one end member, is filled with a liquid and the container is closed.

The conditions relating to the filling of a liquid container often differ from its storage conditions, which means that such a high underpressure may form inside the container that the casing part of the container provided with a cylindrical or truncated cone-like casing part may buckle inwards. The formation of underpressure is due particularly to the fall in the temperature of the gas remaining in the container during filling, and to chemical reactions between gases and the liquid being packaged. The cooling of the liquid also contributes to the formation of an underpressure, although this effect is relatively minor. The buckling problem occurs especially in containers, whose casing part is made of a board-based material, that is, of so-called liquid packaging board, in which case the rigidity of the material is not sufficient to prevent buckling.

Factors causing the formation of underpressure in the empty space in the container include the temperature of the gas in this space at the time of closing the container, the degree to which the container is filled, the temperature of the product being packaged, the temperature of the space where the container is stored, and the product being packaged.

From U.S. Pat. No. 4,338,765 a method is known for solving the problem described above. In this method, when the container is being filled and closed, the base of the container is moved in and out in the manner of bellows by means of a suitable plunger, air blast or suction in order to compensate for the internal pressure changes in the container while packaging liquid which is hot at the time of packaging in the container. It is proposed to use paper, aluminium foil, plastic sheet, or a combination thereof, onto which a thermoplastic resin is laminated or coated, as the material for the base which is to be forced to move in a bellows-like fashion. Only as relatively thin films are these materials sufficiently elastic for the application of the method. Such thin films are not, however, adequate for making the base of the container strong enough mechanically to withstand the potential forces exerted on the container in the environment where it will be used or transported, for example, in a retail shop shopping trolley. In practice, when applying the method relating to the said patent, it has been necessary to provide the container with a second base made of board material, which acts only as mechanical protection.

SUMMARY OF THE INVENTION

The buckling of the casing part of the container due to the combined effect of the above-mentioned problems is a phenomenon that is relatively difficult to eliminate. The aim of the present invention is, however, to present a method for use in connection with closing a liquid container, by means of which the buckling inwards of the casing part of a liquid container during storage can be prevented. A further aim is to present a method, the application of which makes it unnecessary to provide the container with a separate base acting as mechanical protection, in addition to the thin pressure-balancing base.

These aims are achieved by the method relating to the invention, which is characterised in that the one end member, which has already been incorporated in the container when it is filled, is moistened on its surface outside the container before closing the container. The moistening is preferably carried out by directing a steam jet at the end member. In moistening with steam, the moisture is able to penetrate into the fibre-based material of the end member, which means that the rigidity of the end member is reduced substantially at least for a time, which in turn allows the end member to be elastic when the container is being filled. If, when filling the container, and utilising the elasticity thus achieved, the end member is sucked outwards from its perhaps somewhat convex shape in the direction of the interior of the container, to a perhaps somewhat outwards convex shape, it will be possible, on the one hand, to fill the container to a fuller degree than would otherwise be possible, as a result of which the head space remaining in the container once the end member has returned to its normal position, after the container has been closed, becomes smaller than usual, and above all the bellows-like movement inwards of the end member increases the pressure of the gas in the head space, thus compensating for the fall in pressure following the cooling down of the gas. Significant cooling down of the gas and the fall in pressure following it naturally occur when the liquid packaged in the container is relatively hot.

An alternative way in which the container functions, in which the moistening method relating to the invention is also needed, is illustrated by a situation where the weight of the liquid packed in the container is allowed, either alone or together with external suction, to press the base of the container at least to some extent outwards into a convex shape. In this case, once the container has been closed, the base will not return to its original position, but perhaps partly. A fall in the pressure of the gas remaining in the container while it is being closed may in this case draw the base of the container towards the interior of the container during storage. The base thus acts as a pressure-balancing means and prevents the buckling of the container casing.

The method relating to the invention may be supplemented by a method stage in which the said one end member is shaped before attaching it to the container casing to comprise at least one fold or the like which runs around the end member, close to its skirt. This type of folding or corrugation provides the end member with additional elasticity which can be utilised when the rigidity of the end member is reduced by means of steam moistening.

The elasticity can also be increased in such a way that, when attaching the said one end member to the container casing, the attachment is only done over a part of the length of the skirt. In this way the fold point between the end member and the skirt acts in the same way as the folding or corrugation described above, and gives the end member additional elasticity.

When applying the method relating to the invention, the container may be closed either by attaching one of its end members to it, or alternatively, if filling has been carried out through a filling aperture in one of the end members, the container may be closed by attaching a closure flap over this filling aperture.

LIST OF FIGURES

Figure 2:
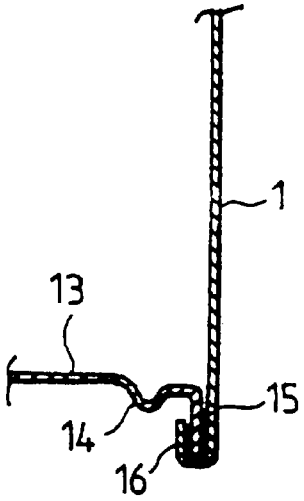

The method relating to the invention is described in greater detail in the following, with reference to the appended drawing in which FIG. 1 shows an example of a container in connection with which the method relating to the invention can be applied, and FIG. 2 shows a cross-section of a part of a container closed according to the method relating to the invention.

DETAILED DESCRIPTION OF THE INVENTION

FIG. 1 shows an example of a container in connection with which the method relating to the invention can be applied. This container comprises a cylindrical casing part 1 and end members 2 and 3 fitted at its end, inside the cylindrical casing. These component parts are made of liquid packaging board, which contains the barrier and other layers required by the product to be packaged in the container in each case. The end members 2 and 3 are attached to the casing part, for example, by folding the edges of the end of the casing part cylinder over the skirts which are formed in the end members parallel with the casing part, and by heat sealing the end members and the casing part together in the area in which they overlap. In the example shown in FIG. 1, the container has been designed to be filled through the filling and emptying aperture 7 in one of its end members 2. When the container is being closed, this aperture is covered with a closure flap 6, which is heat sealed to the lid 2. It should be noted already at this stage that the method relating to the invention may also be applied to a container which is filled through the other end member of the container, as shown in FIG. 1, such as the lid 2, so that when filled, the container is finished with respect to its casing part and one end member, and filling is carried out before attaching the other end member through the end of the casing part which is still open. When the container is closed, this other end member is then attached to the casing part 1.

During manufacture, and especially during storage, of the container relating to FIG. 1, a problem is presented by the temperature variations of the gas remaining in the container after it has been filled with liquid, and the pressure changes resulting therefrom, as a result of which the outward appearance of the container may suffer when the container casing buckles inwards. By means of the method relating to the invention, this buckling phenomenon can be eliminated. A starting point for the invention is the idea known also from the U.S. Pat. No. 4,338,765 that the base of a cylindrical or truncated cone-like container can be used like a bellows for controlling the internal pressure of the container. The base of the container can be drawn outwards during filling, which means that the container can be filled to a fuller degree than would otherwise be possible. When, after closing, the base of the container is then allowed to return to its normal position, the interior volume of the container is reduced and thus also the volume of the head space remaining inside it is reduced to a corresponding extent, increasing the pressure in this space. When the gas in the head space is hot or, when packaging a warm liquid, relatively hot, the pressure of this gas falls as the liquid, and thus also the gas, cools down, and it is precisely this fall in pressure causing buckling of the container casing that the above-mentioned reduction in interior volume can compensate for. In this way, the pressure existing inside the container at a normal temperature can be made such that it will not cause buckling of the container inwards, nor bulging of the container outwards.

In the alternative way in which the container functions, the weight of the liquid packed in the container is allowed, either alone or together with external suction, to press the base of the container at least to some extent outwards into a convex shape. In this case, once the container has been closed, the base will not return to its original position, but perhaps partly. A fall in the pressure of the gas remaining in the container while it is being closed may in this case draw the base of the container towards the interior of the container during storage. The base thus acts as a pressure-balancing means and prevents the buckling of the container casing.

The procedures described above for controlling the pressure in the container may both be used in one and the same container as differently weighted alternatives. In this way a container can be achieved, in the interior of which a relatively low overpressure prevails at the time of closing the container, the said pressure being compensated for as the liquid packaged in the container cools down, and should the pressure tend to fall to a level to underpressure, the bellows-like movement of the base will compensate for this underpressure.

In order to be able to use the base of the container in the bellows-like manner described above for controlling the interior volume of the container, the base of the container must be sufficiently elastic. In the said U.S. Pat. No. 4,338,765 the required elasticity has been achieved by using a relatively thin film as base material. This is, however, an unsatisfactory solution with a view to the mechanical durability of the container, especially as regards the base. The idea relating to the present invention is, in fact, that if the container is made of a fibrous material such as board-based material, especially liquid packaging board having a basis weight of, for example, 180 g, the rigidity of this material may be affected on a short-term basis by moistening it with steam immediately before filling the container.

In the method relating to the invention the procedure is, therefore, such that when an empty container approaches the filling station, a steam jet, water jet, water mist jet or the like of short duration is directed at its base, the said jet being able to moisten the fibrous material of the base so that the rigidity of the base is substantially reduced. It might be possible to use other liquids than water for moistening, either as such or in an aqueous solution. The most preferable alternative is probably to use a steam jet. Through moistening, the end member can be made elastic enough to be suitable for use in adjusting the pressure of the interior of the container, as described above.

To be able to utilise the method relating to the invention as efficiently as possible, various supplementary measures and solutions can also be used. One such basic solution is that a base of a container, or more generally its end member, which is to function like a bellows, should have as large a diameter as possible so that it will already naturally settle to some extent towards the interior of the container, into a convex shape. When the rigidity of an end member of this type is then suitably reduced and made to pop outwards into a corresponding convex shape, the distance of travel of the end member can be made long and thus also its effect on the volume of the interior of the container can be made considerable.

The bellows-like functioning of the end member can be further facilitated by means of the measures shown in FIG.

2. To begin with, before its attachment to the container casing 1, the end member 13 can be shaped to comprise at least one fold 14 or the like which runs around the end member 13, near its skirt 15. By means of this type of folding or corrugation, the magnitude of the bellows-like movement of the main part of the end member can be increased. In this case, too, the prerequisite for achieving the said bellows-like movement is that the rigidity of the end member is sufficiently low, and this is what is in fact achieved by moistening it in accordance with the invention, as described above.

In FIG. 2, the length of the skirt 15 of the end member is chosen to be such that it will not be seamed to the section 16 folded over the skirt 15 of the casing 1 over its entire length. FIG. 2 shows that the skirt 15 continues a slight distance beyond the folded edge 16 of the casing 1, which means that the fold point between the skirt 15 and the remaining part of the end member 13 can give way, also when the end member is sucked outwards. This measure also increases the magnitude of the bellows-like movement of the end member 13.

Above are described various measures by means of which the interior volume of a container made of a relatively rigid material, such as a fibre- or board-based material, and comprising a cylindrical or truncated cone-like casing can be changed in order to stabilise the pressure inside it to such a level that this pressure will not cause aesthetic defects in the outward appearance of the container. It should be understood that in connection with the basic idea of the invention, that is, the moisturisation, other procedures may also be used for creating a bellows-like movement and controlling its extent than those described above. This especially concerns the obtaining of the bellows-like movement by means of various mechanical instruments such as plungers, suction cups or the like. Thus, certain details of the invention may be changed from those presented in the above examples without, however, deviating from the scope of protection determined by the appended claims. It is obvious that the procedures described above may be combined, or perhaps applied separately, depending on the need at hand, that is, on the extent of the bellows-like movement required at any time, which is in turn determined by the type of liquid packaged in the container and its properties, and especially on its temperature at the time of packing.

What is claimed is:

1. A method for use in connection with closing a liquid packaging container, the container comprising a cylindrical or truncated cone-like casing part and end members connected to it, of which at least one is formed of fibre board-based material and comprises a skirt folded in the direction of the casing part, by which skirt the end member is connected to the casing, which method comprises filling the container, which is finished at least with respect to its casing part and the one end member, with a liquid and closing the container, and reducing the rigidity of the one end panel by moistening the surface of the one end member which is on the outside of the container before the container is closed.

2. A method as claimed in claim 1, wherein the moistening is carried out by directing a steam jet at the end member.

3. A method as claimed in claim 1, comprising shaping the one end member before attaching it to the container casing to comprise at least one fold which runs around the end member, near its skirt.

4. A method as claimed in claim 1, comprising, when the one end member is being attached to the container casing, performing the attachment over a part of the length of the skirt.

5. A method as claimed in claim 1, wherein the container is closed by attaching one of the end members to the casing part.

6. A method as claimed in claim 1, wherein the container is closed by attaching a closure flap over the filling aperture in one of the end members.

* * * * *